US006070667A

United States Patent [19]

Gano

[11] Patent Number: 6,070,667

[45] Date of Patent: Jun. 6, 2000

[54] LATERAL WELLBORE CONNECTION

[75] Inventor: John C. Gano, Carrollton, Tex.

[73] Assignee: Halliburton Energy Services, Inc., Houston, Tex.

[21] Appl. No.: 09/019,215

[22] Filed: Feb. 5, 1998

[51] Int. Cl.[7] ..... E21B 7/08; E21B 43/14

[52] U.S. Cl. ..... 166/313; 166/50; 166/117.6; 175/81

[58] Field of Search ..... 166/50, 117.5, 166/117.6, 313; 175/61, 79, 80, 81

[56] References Cited

U.S. PATENT DOCUMENTS

| | | | |
|---|---|---|---|
| 3,075,586 | 1/1963 | Schwab et al. | 166/117.5 |
| 3,082,823 | 3/1963 | Hower . | |
| 3,467,208 | 9/1969 | Kelly . | |
| 3,782,466 | 1/1974 | Lawson et al. . | |
| 3,908,759 | 9/1975 | Cagle et al. | 166/117.6 |
| 3,933,204 | 1/1976 | Knapp . | |
| 3,960,801 | 6/1976 | Cole et al. . | |
| 3,967,135 | 6/1976 | Anderson . | |
| 4,042,031 | 8/1977 | Knapp . | |
| 4,072,194 | 2/1978 | Cole et al. | 166/295 |
| 4,101,474 | 7/1978 | Copeland et al. . | |
| 4,113,015 | 9/1978 | Meijs . | |
| 4,215,001 | 7/1980 | Elphingstone et al. . | |
| 4,220,566 | 9/1980 | Constien et al. . | |
| 4,272,384 | 6/1981 | Martin . | |
| 4,336,842 | 6/1982 | Graham et al. | 166/276 |
| 4,483,888 | 11/1984 | Wu | 427/336 |
| 4,489,785 | 12/1984 | Cole | 166/295 |
| 4,665,988 | 5/1987 | Murphey et al. . | |
| 4,741,401 | 5/1988 | Walles et al. . | |
| 4,785,884 | 11/1988 | Armbruster | 166/280 |
| 4,921,047 | 5/1990 | Summers et al. . | |
| 4,972,906 | 11/1990 | McDaniel . | |
| 5,113,938 | 5/1992 | Clayton | 166/117.6 |
| 5,159,980 | 11/1992 | Onan et al. . | |
| 5,168,928 | 12/1992 | Terry et al. . | |
| 5,293,938 | 3/1994 | Onan et al. . | |
| 5,314,023 | 5/1994 | Dartez et al. . | |
| 5,325,723 | 7/1994 | Meadows et al. | 73/794 |
| 5,335,726 | 8/1994 | Rodrigues . | |
| 5,337,824 | 8/1994 | Cowan . | |
| 5,346,017 | 9/1994 | Blount et al. | 166/380 |
| 5,358,044 | 10/1994 | Hale et al. . | |
| 5,358,051 | 10/1994 | Rodrigues . | |
| 5,361,841 | 11/1994 | Hale et al. . | |
| 5,361,842 | 11/1994 | Hale et al. . | |
| 5,368,102 | 11/1994 | Dewprashad et al. . | |
| 5,373,901 | 12/1994 | Norman et al. . | |
| 5,377,757 | 1/1995 | Ng . | |
| 5,458,195 | 10/1995 | Totten et al. . | |
| 5,547,027 | 8/1996 | Chan et al. | 166/295 |
| 5,559,086 | 9/1996 | Dewprashad et al. . | |
| 5,564,503 | 10/1996 | Longbottom et al. | 166/313 |
| 5,615,740 | 4/1997 | Comeau et al. | 166/117.5 X |
| 5,806,600 | 9/1998 | Halford, Sr. | 166/117.6 X |
| 5,845,710 | 12/1998 | Longbottom et al. | 166/313 |
| 5,871,046 | 2/1999 | Robison | 166/117.6 X |

FOREIGN PATENT DOCUMENTS

| | | |
|---|---|---|
| N09000131 | 8/1990 | WIPO . |
| N09300173 | 11/1993 | WIPO . |

*Primary Examiner*—George Suchfield
*Attorney, Agent, or Firm*—Konneker and Smith

[57] ABSTRACT

Apparatus and methods are provided for achieving a lateral wellbore connection in a subterranean well. In one described embodiment, a deflection device is rotatably attached to one orienting member and conveyed into a cementing shoe positioned in a parent wellbore of the well, wherein the orienting member is engaged with another, complementarily shaped, orienting member. The deflection device is then rotated to face toward the lateral wellbore-to-be-drilled and a force is applied to the deflection device, thereby fixing its rotational orientation relative to the orienting members. Cutting tools are deflected off of the deflection device to cut outward through the cementing shoe to form the lateral wellbore.

23 Claims, 6 Drawing Sheets

LATERAL WELLBORE CONNECTION

BACKGROUND OF THE INVENTION

The present invention relates generally to operations performed in conjunction with subterranean wells and, in an embodiment described herein, more particularly provides apparatus and methods for achieving a lateral wellbore connection.

Where it is desired to drill a lateral wellbore from a parent wellbore, it is common practice to position a whipstock in casing lining the parent wellbore, and then mill a window through the casing. The lateral wellbore may then be drilled outward from the parent wellbore by passing drill bits through the window. Unfortunately, these operations are usually very time-consuming and, therefore, very expensive to perform.

It would be advantageous to provide an exit joint made of a drillable material in the parent wellbore casing string, so that the time involved in milling through the casing would be virtually eliminated. For operational efficiency and structural integrity of the lateral wellbore connection, it would be desirable for the exit joint to be configured as a cementing shoe or other portion of a typical casing string.

Since passage of tools, tubular members and other equipment from the parent wellbore to the lateral wellbore generally requires some rotational orientation, it would also be advantageous to provide apparatus which reduces the time required to rotationally orient items of equipment in the well. For example, one deflection device may be used to guide a drill bit to cut through the casing string, and thereafter another deflection device may be used to guide other equipment from the parent wellbore to the lateral wellbore. The second deflection device could be rotationally oriented using the rotational orientation of the first deflection device.

Accordingly, it is an object of the present invention to provide a lateral wellbore connection which does not require time-consuming milling operations, and which does not require repetitive downhole rotational orientation of items of equipment used therein.

SUMMARY OF THE INVENTION

In carrying out the principles of the present invention, in accordance with an embodiment thereof, a lateral wellbore connection is provided which is efficient and economical in its construction and operation. Apparatus provided by the invention facilitate orientation of items of equipment within a well and otherwise enhance construction of the lateral wellbore connection. Associated methods are also provided.

In broad terms, the invention encompasses apparatus and methods for achieving a lateral wellbore connection. The apparatus include those useful for orienting a deflection device and other items of equipment relative to a lateral wellbore, and an exit joint formed of drillable material and configured as a cementing shoe. The methods include orienting the deflection device relative to the lateral wellbore-to-be-drilled and then fixing the rotational orientation of the deflection device relative to an orienting member attached thereto.

In one aspect of the present invention, a deflection device is rotatably attached to an orienting member. A release member releasably secures the deflection device in a first position in which the deflection device may rotate relative to the orienting member. When the deflection device displaces to a second position, the rotational orientation of the deflection device is fixed relative to the orienting member.

In another aspect of the present invention, another orienting member is positioned in the parent wellbore. The deflection device and the orienting member attached thereto are conveyed into the well with the deflection device in the first position. The two orienting members are then cooperatively engaged with each other to prevent rotation therebetween. The deflection device is rotated to align it with the lateral wellbore-to-be-drilled, and a force is applied to the deflection device to displace it to the second position, thereby fixing its rotational orientation relative to the lateral wellbore-to-be-drilled.

In still another aspect of the present invention, the deflection device is positioned at least partially in a cementing shoe when the orienting members are engaged. The cementing shoe is made of a drillable material, so that drill bits may be deflected off of the deflection device and cut through a sidewall of the cementing shoe.

These and other features, advantages, benefits and objects of the present invention will become apparent to one of ordinary skill in the art upon careful consideration of the detailed descriptions of representative embodiments of the invention hereinbelow and the accompanying drawings.

DETAILED DESCRIPTION

Figure 1:
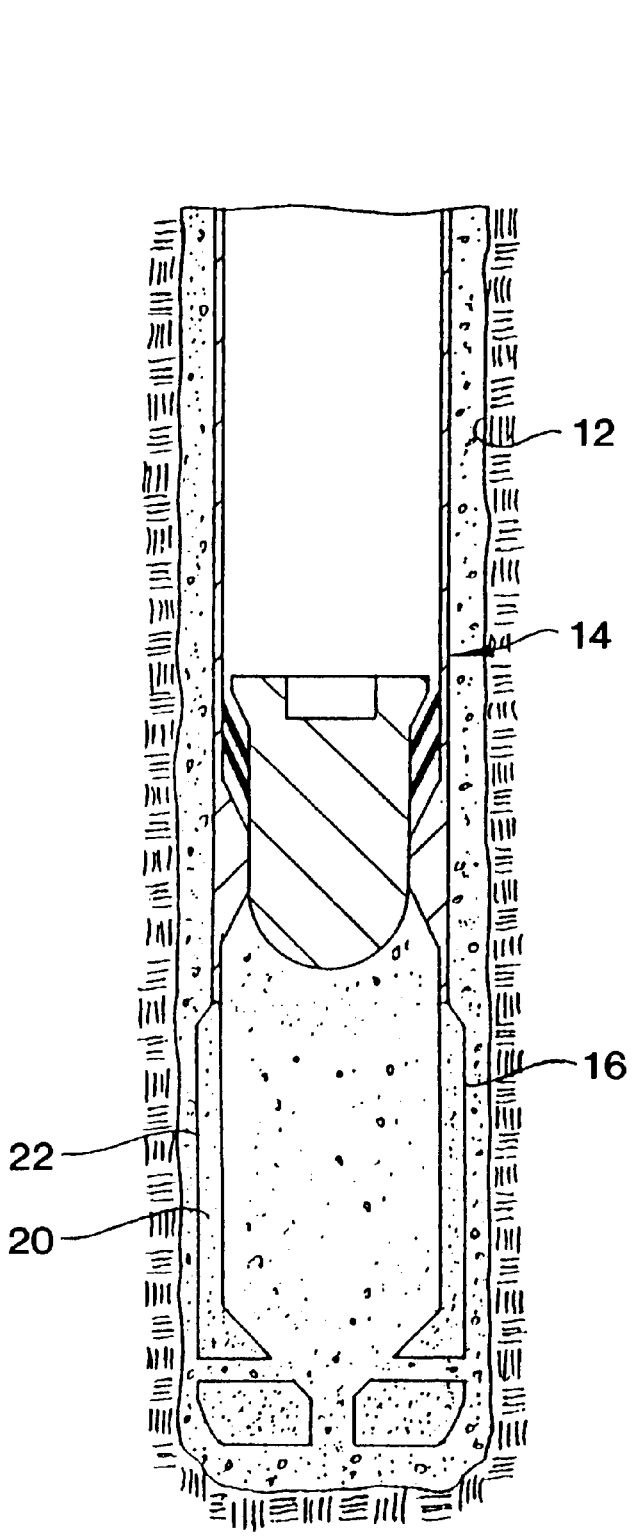
FIG. 1 is a schematic cross-sectional view of a first apparatus and method of drilling a subterranean well, initial steps of the method having been performed, and the first method and apparatus embodying principles of the present invention.

Representatively and schematically illustrated in FIG. 1 is a method 10 which embodies principles of the present invention. In the following description of the method 10 and other methods and apparatus described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

As depicted in FIG. 1, initial steps of the method 10 have been performed. A parent wellbore 12 has been drilled to a depth at which it is desired to install a string of casing 14. The method 10 advantageously uses a specially configured cementing shoe 16 as a part of the casing string 14. The cementing shoe 16 may be threadedly or otherwise attached to the remainder of the casing string 14 and is sealingly attached thereto.

Figure 2:
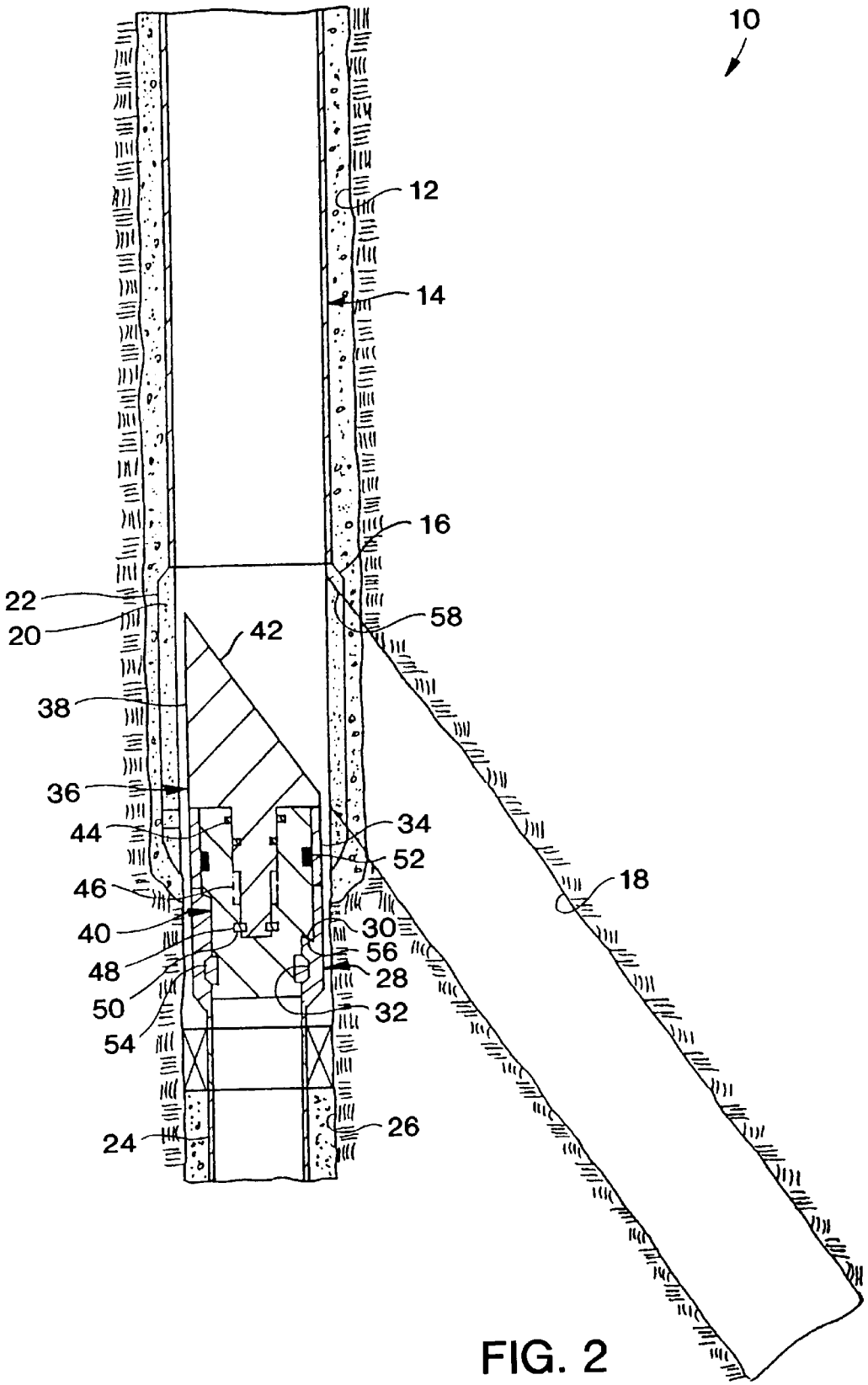
FIG. 2 is a schematic cross-sectional view of a second apparatus, and in which further steps of the first method have been performed, the second apparatus embodying principles of the present invention.

The cementing shoe 16 is also configured for use as an exit joint for drilling a lateral wellbore 18 (see FIG. 2). For this purpose, the cementing shoe 16 is made of one or more drillable materials. For example, the cementing shoe 16 may include an inner filler material 20 and an outer case or container 22 enveloping the filler material. The inner filler material 20 may be cement or other cementitious material, may be reinforced, as with graphite or polypropylene fibers, etc., and may be integrally formed with the outer case 22. The outer case 22 may be fiber-reinforced resinous material, or it may be metallic, such as aluminum, etc. Of course, other materials may be used to construct the cementing shoe 16 without departing from the principles of the present invention.

As shown in FIG. 1, the cementing shoe/exit joint 16 is positioned at or very near the lower end of the casing string 14. This is an advantageous position for the exit joint 16 in the method 10, since in normal practice the lower end of a casing string is usually located in rock or other consolidated and stable formation. Thus, when the cementing operation is performed and the cementing shoe 16 is cemented in place as depicted in FIG. 1, the lower end of the casing string 14 is preferably, in a stable formation and is at least somewhat protected from damage during subsequent drilling and completion operations. For convenience and clarity of illustration, conventional steps and items of equipment used in the cementing operation are not shown in the drawings or described herein, these being well known to those of ordinary skill in the art.

Referring additionally now to FIG. 2, the method 10 is schematically and representatively illustrated in which additional steps have been performed. The parent wellbore 12 has been extended by drilling downward through the casing string 14. Another casing or liner 24 has then been installed in a lower portion 26 of the parent wellbore 12 and cemented in place.

Threadedly and sealingly attached at an upper end of the casing or liner 24 is an orienting member 28. The orienting member 28 includes an internal laterally inclined annular surface 30 and an internal annular recess or latching profile 32. Threadedly and sealingly attached above the orienting member 28 is a seal bore or polished bore receptacle (PBR) 34.

In the method 10, the casing 24, orienting member 28 and PBR 34 are installed in the parent wellbore 12, and the casing is cemented in place, before the lateral wellbore 18 is drilled. As shown in FIG. 2, the inclined surface 30 may be oriented to face radially toward the lateral wellbore-to-be-drilled, or it may be otherwise directed, as will be explained in further detail below. Additionally, note that the PBR 34 and an upper portion of the orienting member 28 extend above the lower parent wellbore 26, with at least the PBR extending into the cementing shoe 16. Thus, it is possible to place cement about the PBR 34 and orienting member 28 to further isolate the formation surrounding the lateral wellbore connection (see FIG. 4).

When it is desired to drill the lateral wellbore 18, an assembly 36 is conveyed into the parent wellbore 12, for example, by lowering the assembly via a work string, coiled tubing, etc. in a conventional manner. The assembly 36 includes a deflection device 38 and an orienting member 40. The deflection device 38 has a laterally inclined upper surface 42 formed thereon for deflecting cutting tools, such as drill bits, tubular members, other items of equipment, etc., laterally with respect to the parent wellbore 12. The deflection device 38 and orienting member 40 are representatively shown in FIG. 2 as being solid, but it will be readily appreciated that these elements could be made generally tubular, that is, having axial flow passages formed therethrough.

When the assembly 36 is conveyed into the parent wellbore 12, the deflection device 38 is free to rotate relative to the orienting member 40. A release member or annular shear ring 44 attaches the deflection device 38 to the orienting member 40 and permits relative rotation therebetween. However, as shown in FIG. 2, the deflection device 38 has been downwardly displaced relative to the orienting member 40, thus shearing the shear ring 44, and the deflection device is no longer permitted to rotate relative to the orienting member.

Complementarily shaped mating splines 46 are formed on each of the deflection device 38 and orienting member 40, so that, when the assembly 36 is being conveyed into the well, the splines are disengaged, thereby permitting relative rotation between the deflection device and the orienting member 40. However, when the orienting member 40 is engaged with the PBR 34 and orienting member 28, and a downwardly directed axial force is applied to the deflection device 38 to shear the shear ring 44, such as by slacking off on a work string attached thereto at the earth's surface to thereby apply a portion of the work string's weight to the deflection device, the deflection device will displace axially downward and the splines 46 will engage, thereby preventing relative rotation between the deflection device and the orienting member 40. Of course, other types of rotational locks may be used in place of the splines 46, such as clutches, other cooperatively engageable projections and recesses, etc., and other types of release members may be used in place of the shear ring 44, without departing from the principles of the present invention.

A latch member or snap ring 48 is carried externally on the deflection device 38. When the deflection device 38 is downwardly displaced relative to the orienting member 40 as described above, the snap ring 48 radially outwardly extends into an annular recess or groove 50 formed internally on the orienting member 40. The snap ring 48 prevents the deflection device 38 from displacing upwardly relative to the orienting member 40 after the deflection device has displaced downwardly as shown in FIG. 2. Thus, the snap ring 48 maintains the splines 46 in engagement, and thereby prevents any relative rotation between the deflection device 38 and the orienting member 40.

The orienting member 40 has a circumferential seal 52 carried externally thereon, which sealingly engages the PBR 34 when the assembly 36 is installed. Use of the seal 52 is optional, since it may not be desired to sealingly engage the assembly 36 with the orienting member 28, liner 24, etc. In that case use of the PBR 34 would be optional as well.

Also carried on the orienting member 40 are a series of circumferentially spaced apart keys or lugs 54 of conventional design for latching engagement with the latching profile 32. Additionally, a laterally inclined annular surface 56 is formed externally on the orienting member 40 for complementary engagement with the inclined surface 30 of the orienting member 28.

As the upper orienting member 40 engages the PBR 34 and lower orienting member 28, several functions are performed. The seal 52 sealingly engages the PBR 34. The inclined surfaces 30, 56 engage each other. If the upper orienting member 40 is not radially aligned with the lower orienting member 28, the surfaces 30, 56 will cooperate to cause the upper orienting member to rotate into radial alignment with the lower orienting member. At this point, the upper orienting member 40 is free to rotate relative to the deflection device 38. When the upper orienting member 40 is radially oriented with respect to the lower orienting member 28, the keys 54 engage the latching profile 32, thereby latching the orienting members together, with the surfaces 30, 56 preventing further rotation of the orienting members relative to each other.

After the orienting members 28, 40 have been radially aligned and latched together, the deflection device 38 is oriented so that the surface 42 faces toward the lateral wellbore-to-be-drilled using conventional methods, such as by using a gyroscope included in the work string used to convey the assembly 36 into the parent wellbore 12. An axially downwardly directed force is then applied to the deflection device 38, such as by applying a portion of the work string's weight to the deflection device. This force causes the shear ring 44 to shear, releasing the deflection device 38 for displacement relative to the orienting member 40. The deflection device 38 displaces downward, engaging the splines 46 and engaging the snap ring 48 in the groove 50. At this point, the deflection device 38 is rotationally locked with respect to the wellbore 12, and will remain in this position indefinitely, with the surface 42 facing toward the lateral wellbore-to-be-drilled.

One or more cutting tools, such as drill bits, may be lowered through the casing string 14 and deflected by the surface 42 to cut laterally through the cementing collar 16. In this manner, no milling is required to cut a window through the casing string 14. An opening 58 is drilled through a sidewall of the cementing collar 16 and extended outward from the parent wellbore 12 to form the lateral wellbore 18.

Due to wear or other reasons, it may be desired to install another deflection device or other item of equipment at the lateral wellbore connection. The method 10 and apparatus shown in FIGS. 1 & 2 and described above are particularly well suited for repetitive rotational alignment of items of equipment relative to the wellbore 12 in these circumstances. The upper orienting member 40 may be unlatched from the lower orienting member 28, such as by applying an axially upwardly directed force to the assembly 36 to disengage the keys 54 from the latching profile 32, and the upper orienting member may be retrieved to the earth's surface with the deflection device 38 attached thereto.

Note that the deflection device 38 remains rotationally locked to the orienting member 40 as they are retrieved. At the earth's surface, an operator may note the orientation of the deflection device 38 relative to the orienting member 40. The operator may then attach another deflection device or other item of equipment to the orienting member 40 in the same orientation as the previously attached deflection device 38.

Thus, when the newly-attached item of equipment and the upper orienting member 40 are installed in the well and the orienting members 40, 28 are again engaged with each other, the newly-attached item of equipment may have the same radial orientation relative to the wellbore 12 as the deflection device 38 previously had. Of course, the newly-attached item of equipment might also be attached to the upper orienting member 40 with a different radial orientation, without departing from the principles of the present invention. Additionally, the newly-attached item of equipment might be attached to another upper orienting member, similar to the upper orienting member 40, but not necessarily including the features which permit rotation and then rotational locking between the item of equipment and the upper orienting member, since radial orientation of the newly attached item of equipment relative to the upper orienting member may be fixed before conveyance into the well.

Figure 3:
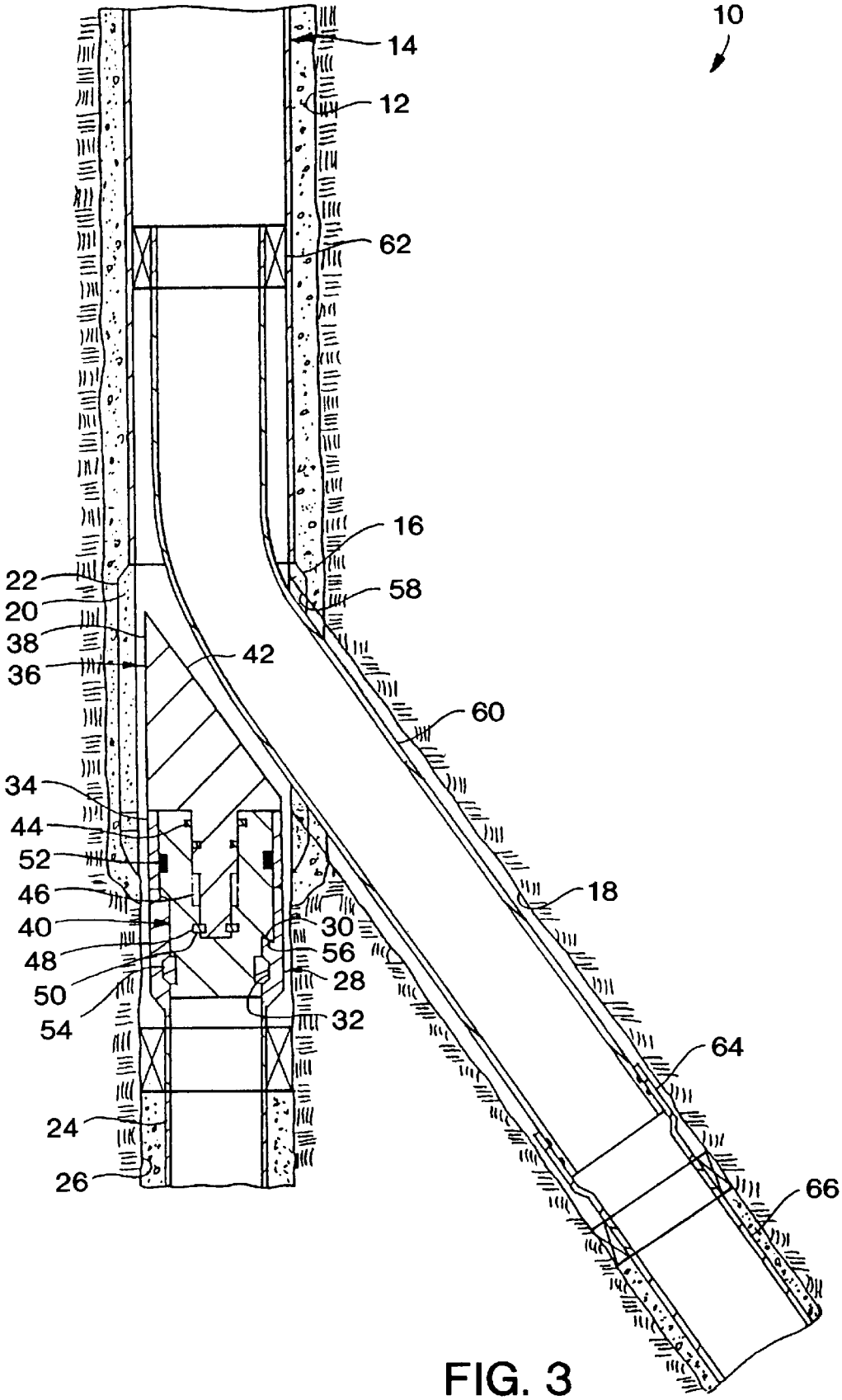
FIG. 3 is a schematic cross-sectional view of the first method in which optional steps in drilling a lateral wellbore are performed.
Figure 4:
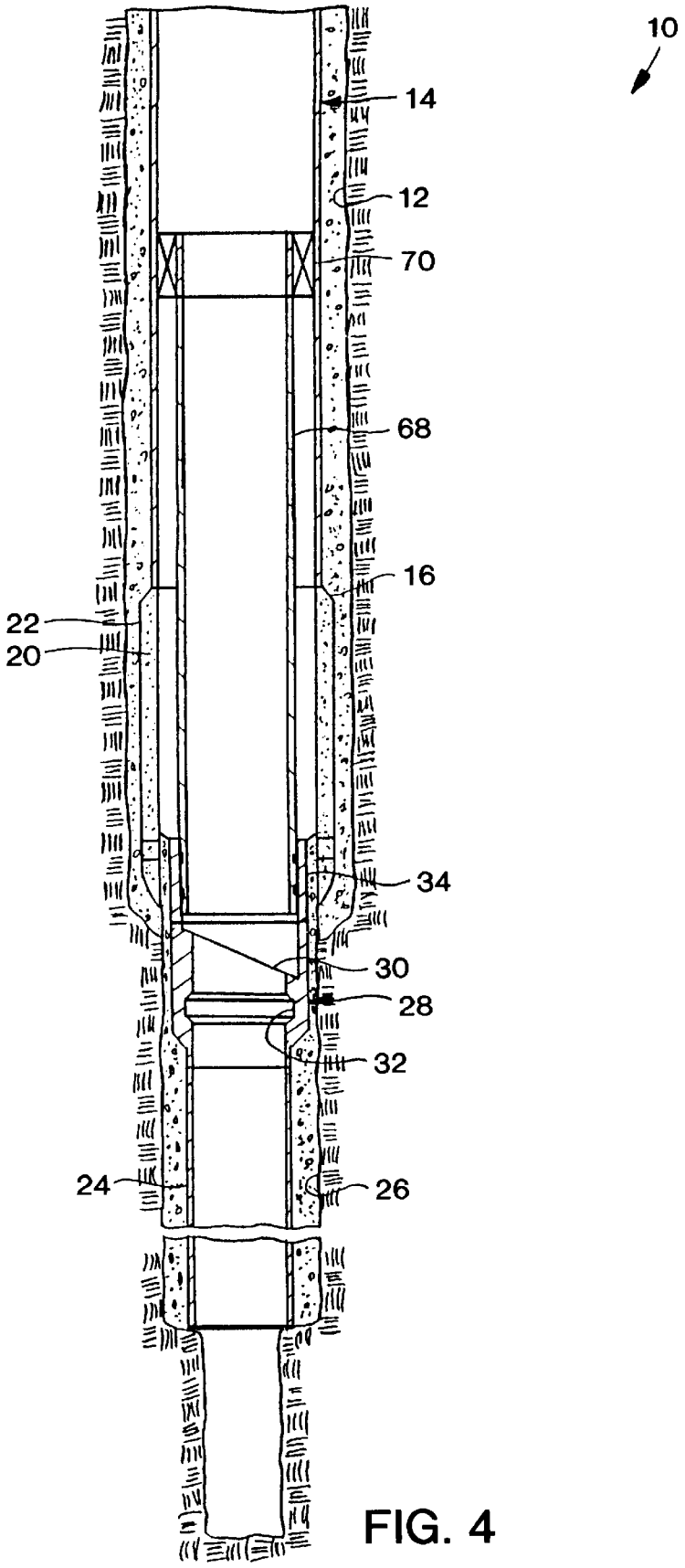
FIG. 4 is a schematic cross-sectional view of the first method in which optional steps in drilling a parent wellbore are performed.

Referring additionally now to FIGS. 3 & 4, optional steps of the method 10 are schematically shown, which may be utilized when relatively high pressure drilling or other operations are performed through the lateral wellbore connection. In FIG. 3, a liner 60 or other tubular member is shown inserted through the opening 58 formed through the cementing shoe 16 sidewall. The upper end of the liner 60 is sealingly disposed within the parent wellbore 12 in the interior of the casing 14. The lower end of the liner 60 is sealingly disposed within the lateral wellbore 18.

The upper end of the liner 60 is sealingly, engaged with the casing string 14 by a packer or liner hanger 62 attached to the liner. The lower end of the liner 60 is sealingly engaged with a PBR 64 attached to another liner or other tubular member 66 cemented in the lateral wellbore 18. Of course, many other ways of sealing the liner 60 in the parent and lateral wellbores 12, 18 may be used in the method 10 without departing from the principles of the present invention.

It will be readily appreciated that such sealing engagement of the liner 60 operates to isolate the lateral wellbore connection from fluid pressures present in the casing string 14 above the liner 60, such as those that might be experienced when the lateral wellbore 18 is drilled further outward from the parent wellbore 12. Thus, drill bits or other equipment may be conveniently transported through the lateral wellbore connection via the liner 60, and fluid pressures present in the parent wellbore 12 above the lateral wellbore connection will be isolated from the lateral wellbore connection during these operations. When there is no longer a need for the liner 60, it may be retrieved using conventional methods.

In FIG. 4, another liner or other tubular member 68 is positioned extending through the lateral wellbore connection, but in this case the liner is used before the lateral wellbore 18 is drilled. However, it is to be clearly understood that the liner 68 could also be used after the lateral wellbore 18 has been drilled.

As shown in FIG. 4, the liner 68 is inserted through the cementing shoe 16 after the casing 24, orienting member 28 and PBR 34 are installed and cemented within the lower parent wellbore 26. The liner 68 is sealingly engaged within the casing string 14 above the cementing shoe 16 using a packer or liner hanger 70. The lower end of the liner 68 is sealingly engaged with the PBR 34. In this manner, the parent wellbore 12 may be extended by passing drill bits, etc. through the casing string 14, liner 68 and casing 24, without applying any excessive fluid pressure to the lateral wellbore connection.

Figure 5:
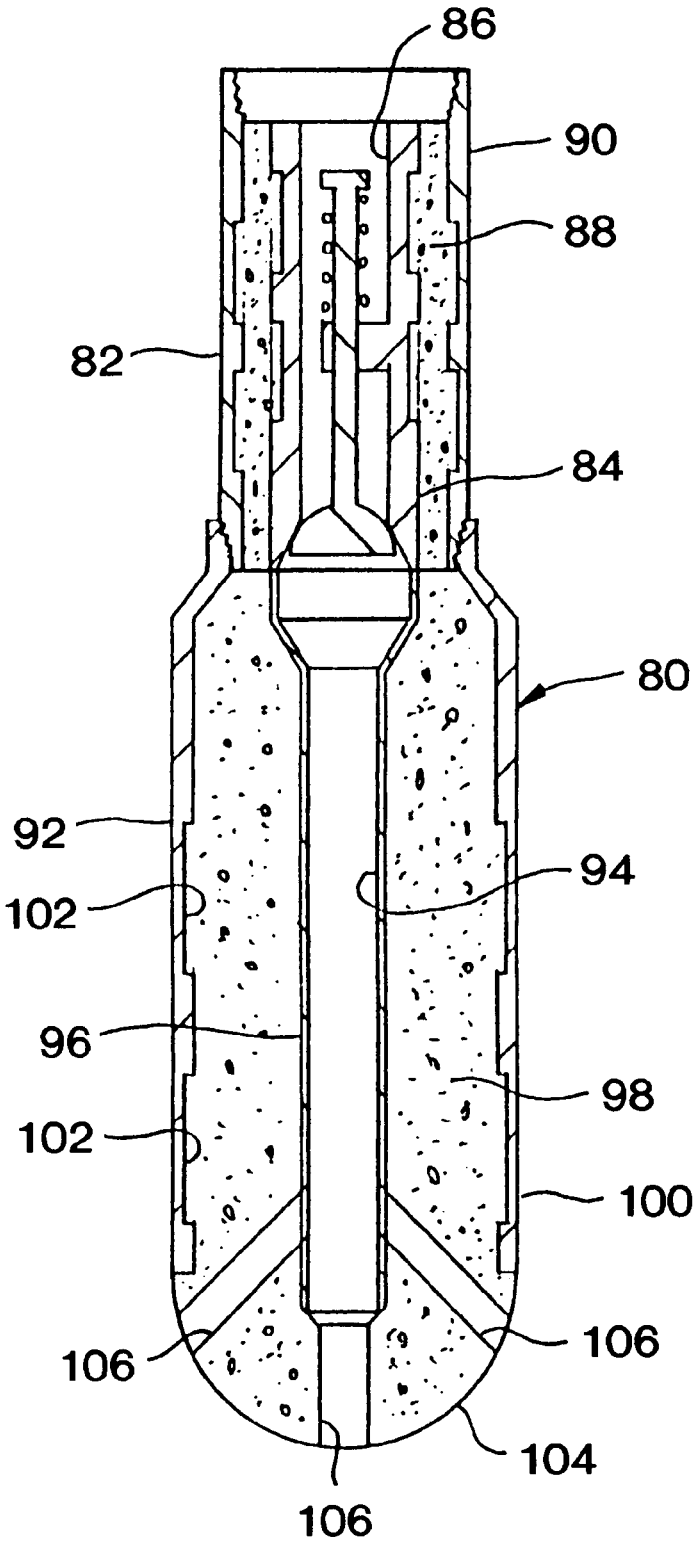
FIG. 5 is a schematic cross-sectional view of a third apparatus embodying principles of the present invention.

Referring additionally now to FIG. 5, an apparatus 80 embodying principles of the present invention is representatively and schematically illustrated. The apparatus 80 may be used in the method 10 described above, and may be used in other methods as well. In many respects, the apparatus 80 is similar to the cementing shoe 16 described above, but differs in some respects also.

The apparatus 80 includes a float collar 82 similar to float collars of conventional design and well known to those skilled in the art. The float collar 82 includes a float valve 84, which permits flow of cement or other material downwardly through an axial flow passage 86 formed therethrough, but prevents flow upwardly through the float collar. At least the float valve 84 portion of the float collar 82 is made of drillable material, such as aluminum, etc., and an annular area 88 between the float valve and an outer tubular housing 90 may be filled with the same or another drillable material, such as cement. An upper end of the housing 90 is configured for threaded and sealing attachment to a tubular member, such as casing of the casing string 14 shown in FIG. 1.

Threadedly and sealingly attached below the float collar 82 is a cementing shoe 92. An axial flow passage 94 formed through the cementing shoe 92 is aligned with the flow passage 86 of the float collar 82. When the float valve 84 is open, fluid or other material may flow from the flow passage 86 to the flow passage 94.

The flow passage 94 is lined with a tubular flow conductor 96, which limits erosion of a filler material 98 radially outwardly surrounding the flow passage. The filler material 98 may be similar to the filler material 20 used in the cementing shoe 16 described above. The filler material 98 is shown in FIG. 5 as being made of cement, but it is to be understood that it may actually be a resinous material, a polymer, a fiber-reinforced material, an elastomer, or any of a variety of drillable materials.

The cementing shoe 92 is attached to the float collar 82 by means of an outer tubular housing or case 100. The case 100 at least partially radially outwardly surrounds the filler material 98 and may include retaining structures, such as annular recesses 102, etc., formed internally thereon or attached thereto, for preventing movement of the filler material 98 relative thereto. The case 100 is preferably made of a drillable material, such as aluminum, etc., so that an opening, such as opening 58 shown in FIG. 2, may be easily drilled laterally therethrough.

Note that the case 100 envelopes a substantial portion of the filler material 98, but that a lower generally hemispherical-shaped portion 104 of the filler material extends downwardly and outwardly therefrom. Thus, it is not necessary for the case 100 to completely circumscribe the filler material 98 in keeping with the principles of the present invention. Of course, the lower portion 104 may be otherwise shaped, and the case 100 may otherwise envelope the filler material 98, or be integrally formed therewith, without departing from the principles of the present invention.

The lower portion 104 has flow passages 106 formed therein, each of which intersects the flow passage 94. As shown in FIG. 5, the flow passages 106 are formed through the filler material 98 and are unlined, but it is to be understood that the flow passages may be lined with protective material, and may be otherwise positioned, without departing from the principles of the present invention.

Figure 6:
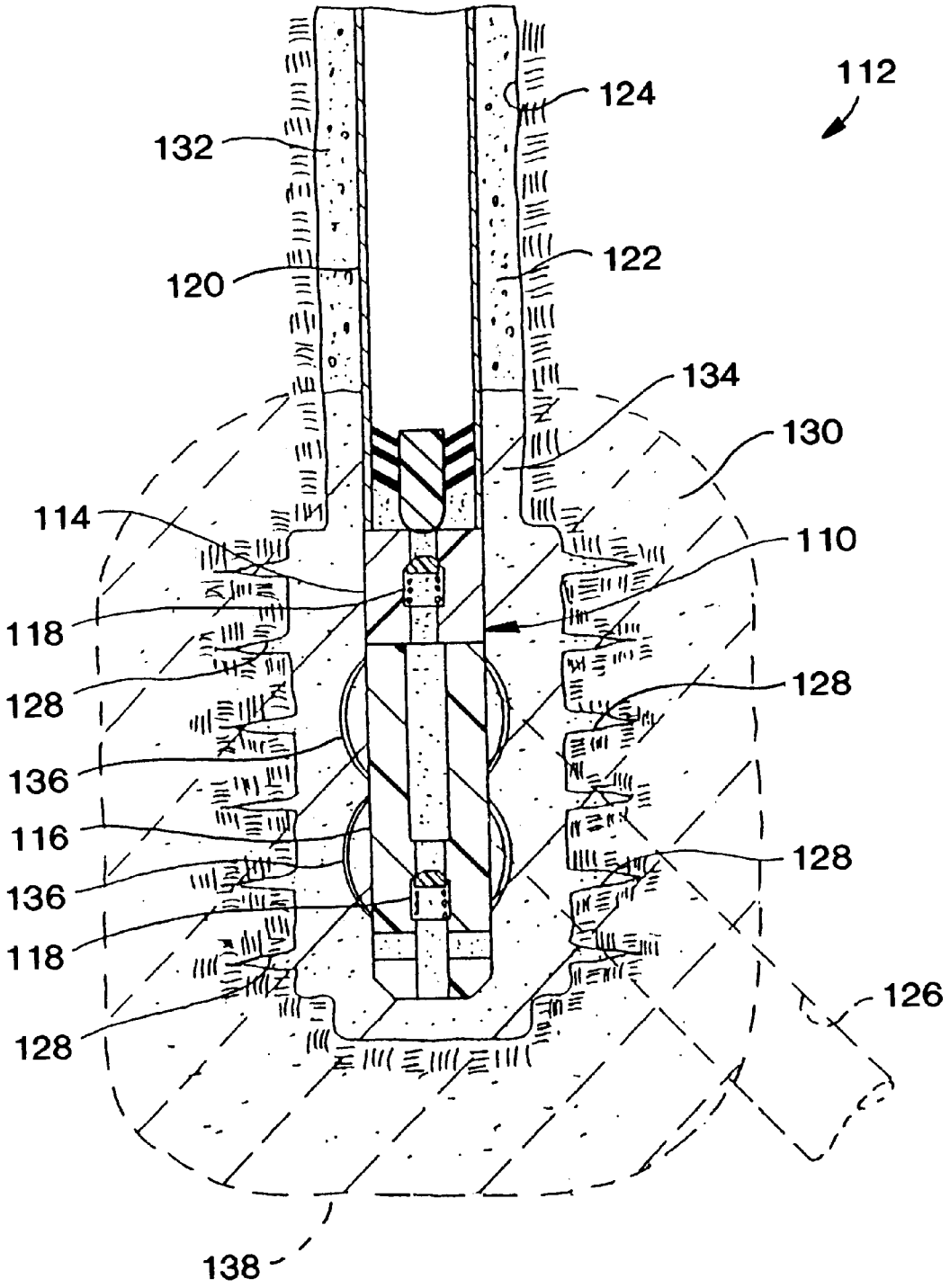
FIG. 6 is a schematic cross-sectional view of a fourth apparatus and second method for drilling a subterranean well, initial steps of the method having been performed, and the fourth apparatus and second method embodying principles of the present invention.

Referring additionally now to FIG. 6, another apparatus 110 and method 112 embodying principles of the present invention are representatively and schematically illustrated. The apparatus 110 may be used in the method 112, in any of the methods described above, or in any other method, without departing from the principles of the present invention. Additionally, the method 112 may use the apparatus 110, any of the other apparatus described above, or other apparatus, in keeping with the principles of the present invention.

The apparatus 110 includes a float collar 114 and a cementing shoe or float shoe 116, each of which is made of drillable material. As shown in FIG. 6, the float collar 114 and cementing shoe 116 are made of a molded plastic or polymer material, but it is to be understood that the float collar and cementing shoe may be made of other drillable materials, or combination of drillable materials, without departing from the principles of the present invention.

Each of the float collar 114 and cementing shoe 116 includes a float valve 118. The float valves 118 permit flow from the interior of a casing or other tubular string 120, from which the apparatus 110 is suspended, to an annulus 122 between the casing string and a wellbore 124 of the well, but prevent flow from the annulus to the interior of the casing string.

As shown in FIG. 6, initial steps of the method 112 have been performed. The wellbore 124 has been drilled, at least to a point where it is desired to drill a lateral wellbore 126 extending outwardly therefrom. The wellbore 124 has been underreamed, that is, radially enlarged at the junction of the parent wellbore and the lateral wellbore-to-be-drilled 126. The lateral wellbore 126 is shown in dashed lines in FIG. 6, since it has not yet been drilled.

Radially outwardly extending tunnels or cavities 128 have been formed in the underreamed portion of the wellbore 124, so that they extend into the formation 130 surrounding the wellbore junction. The radial cavities 128 may be formed by conventional techniques, such as jet cutting, using shaped charges, fracturing the formation during pumping of material 134 thereinto, etc. However, it is to be clearly understood that it is not necessary for the wellbore 124 to be underreamed, or for the underreamed portion to have the cavities 128 formed therein, in the method 112.

The apparatus 110 is then conveyed into the wellbore 124 suspended from the casing string 120. The apparatus 110 is positioned at the wellbore junction, so that the lateral wellbore 126 may be drilled therethrough intersecting the parent wellbore 124, as described above.

Cement 132 is then pumped downwardly through the casing string 120, through the apparatus 10, and upwardly into the annulus 122. Another material 134 is tailed-in behind the cement 132, so that the cement is pushed upwardly into the annulus 122 above the wellbore junction and the material 134 fills the annulus surrounding the apparatus 110, including the underreamed portion of the wellbore 124 and the cavities 128. Of course, the material 134 could also be cement, or another drillable material, without departing from the principles of the present invention. Turbulence inducing structures 136, of the type well known to those skilled in the art, may be included on the apparatus 110 to aid in ensuring that the material 134 "sweeps" through the entire annulus 122 at the wellbore junction. The cement 122 and material 134 are then allowed to set and/or harden.

It will be readily appreciated that, by providing the underreamed portion of the wellbore 124, and by filling the enlarged annulus 122 surrounding the wellbore junction with the material 134, the stability of the wellbore junction is significantly improved. The wellbore junction is, thus, made more resistant to collapse. Other benefits to the wellbore junction provided by the method 112 are more fully described below.

The material 134 may be cement, it may be cement with enhanced properties, such as fiber-reinforced cement, or it may be any of a variety of other materials, such as polymers, epoxy-type materials, etc. For example, the material 134 may be a comparatively low viscosity material, which may be pumped into the formation 130 surrounding the wellbore junction. Dashed lines 138 in FIG. 6 indicate that the material 134 may be forced outwardly into the formation 130 surrounding the wellbore junction, in which case the cavities 128 may be used to present increased surface area for admitting the material into the formation.

In order to force the material 134 outwardly into the formation 130, a conventional operation known as a "top-side squeeze" may be performed after the material has been positioned in the annulus 122 surrounding the apparatus 110. In this operation fluid pressure is applied to the annulus 122 at the earth's surface to squeeze the material 134 into the pores of the formation 130. Of course, the formation 130 preferably has at least a minimal degree of permeability to permit the material 134 to flow thereinto.

Note that, by forcing the material 134 into the formation 130, several benefits may be achieved. The collapse resistance at the wellbore junction may be vastly improved. The tensile strength, compressive strength and ductility of the formation 130 may be improved. The formation 130 may be made impermeable in the area surrounding the wellbore junction by, for example, filling its pores with the material 134. The leak-off and fracture propagation pressures of the formation 130 may be increased. Resistance of the formation 130 to chemicals may be improved. Of course, it is not necessary in the method 112 for all of these benefits to be obtained, since a choice of the material 134 to use in a particular situation may be tailored to the specific well conditions, formation 130 composition and properties, benefits desired, etc.

An example of a material which may be used for the material 134 in the method 112 is described in a copending application Ser. No. 08/914,594, filed Aug. 18, 1997, entitled METHODS OF MODIFYING SUBTERRANEAN STRATA PROPERTIES, attorney docket no. HES 97.0102. The disclosure of that copending application is hereby incorporated by this reference. The application describes a hardenable epoxy composition, such as an epoxide containing liquid selected from the group of diglycidyl ethers of 1,4-butanediol, neopentyl glycol and cyclohexane dimethanol and a hardening agent selected from the group of aliphatic amines, aromatic amines and carboxylic acid anhydrides. Furthermore, the application describes methods of pumping the epoxy composition into subterranean stratum by way of a wellbore penetrating the stratum and by way of the porosity of the stratum, and then allowing the epoxy composition to harden in the stratum.

It will be readily appreciated that the above-described methods of stabilizing a wellbore junction may be used in other types of junctions, and may be utilized before or after drilling a wellbore at a junction. For example, the wellbore junctions representatively illustrated in FIGS. 2 & 6 may be stabilized by forcing the material 134 into the formations surrounding the junctions either before the lateral wellbores 18, 126 are drilled, or after the lateral wellbores are drilled. Additionally, these operations may be performed in conjunction with wellbore stabilization methods described in the incorporated application.

Once the cement 132 and material 134 (if a separate material is utilized) have hardened in the representatively illustrated method 112, the lateral wellbore 126 is drilled in a similar manner as that described above for the method 10. The apparatus 110 may be drilled through and a deflection device utilized to deflect cutting tools outwardly therethrough to form the lateral wellbore 126. Thus, the method 112 does not require any time-consuming milling operations and may be performed in the course of substantially normal drilling and cementing operations.

Of course, many modifications, additions, substitutions, deletions and other changes may be made to the methods 10, 112 and various apparatus described above, which changes would be obvious to a person skilled in the art, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. A method of orienting items of equipment relative to a lateral wellbore, the method comprising the steps of:

positioning a first orienting member in a parent wellbore prior to drilling the lateral wellbore;

conveying a first assembly into the parent wellbore, the first assembly including a deflection device and a second orienting member;

engaging the first and second orienting members;

fixing the radial orientation of the deflection device relative to the second orienting member, the fixing step being performed after the engaging step; and drilling the lateral wellbore by deflecting at least one cutting tool off of the deflection device.

2. The method according to claim 1, wherein in the conveying step, the deflection device is rotatable relative to the second orienting member.

3. The method according to claim 1, wherein the fixing step is performed by applying an axial force to the first assembly.

4. The method according to claim 1, wherein the fixing step is performed by engaging complementarily shaped projections and recesses formed on the deflection device and second orienting member.

5. The method according to claim 1, further comprising the step of retrieving the first assembly from the parent wellbore while maintaining the radial orientation of the deflection device relative to the second orienting member.

6. The method according to claim 5, further comprising the steps of detaching the second orienting member from the deflection device and attaching the second orienting member to an item of equipment.

7. The method according to claim 6, wherein in the attaching step, the item of equipment is secured to the second orienting member using the previous radial orientation of the deflection device relative to the second orienting member.

8. The method according to claim 6, wherein in the attaching step, the item of equipment is secured to the second orienting member in the same radial orientation as the deflection device was fixed relative to the second orienting member.

9. The method according to claim 5, further comprising the steps of attaching a third orienting member to an item of equipment, and replacing the second orientation member with the third orientation member.

10. The method according to claim 9, wherein in the attaching step, the item of equipment is secured to the third orienting member using the previous radial orientation of the deflection device relative to the second orienting member.

11. The method according to claim 9, wherein in the attaching step, the item of equipment is secured to the third orienting member in the same radial orientation as the deflection device was fixed relative to the second orienting member.

12. The method according to claim 1, wherein the engaging step further comprises radially securing the second orienting member relative to the first orienting member.

13. The method according to claim 12, wherein the engaging step further comprises releasably attaching the second orienting member to the first orienting member.

14. The method according to claim 1, wherein each of the first and second orienting members have complementarily shaped laterally inclined surfaces formed thereon, and wherein the engaging step further comprises cooperatively engaging the surfaces.

15. The method according to claim 1, wherein the drilling step includes cutting through a sidewall of a cementing shoe.

16. The method according to claim 1, further comprising the steps of inserting a first tubular member into the lateral wellbore, sealing a lower portion of the first tubular member within the lateral wellbore, and sealing an upper portion of the first tubular member within the parent wellbore.

17. The method according to claim 16, further comprising the step of extending the lateral wellbore by passing the one or more cutting tools through the first tubular member.

18. The method according to claim 16, wherein the step of sealing the lower portion of the first tubular member further comprises sealingly engaging the first tubular member with a second tubular member sealingly disposed within the lateral wellbore.

19. The method according to claim 1, further comprising the steps of inserting a first tubular member into the parent wellbore, sealing a lower portion of the first tubular member within the parent wellbore, and sealing an upper portion of the first tubular member within the parent wellbore.

20. The method according to claim 19, further comprising the step of extending the parent wellbore by passing one or more drill bits through the first tubular member.

21. The method according to claim 19, wherein the step of sealing the lower portion of the first tubular member further comprises sealingly engaging the first tubular member with a second tubular member sealingly disposed within the parent wellbore.

22. The method according to claim 21, wherein the second tubular member is the first orienting member.

23. The method according to claim 19, further comprising the step of isolating an exit joint disposed in the parent wellbore by the sealing engagement of the first tubular member upper and lower portions in the parent wellbore.

* * * * *